US007703525B2

(12) United States Patent
Wilcox et al.

(10) Patent No.: US 7,703,525 B2
(45) Date of Patent: Apr. 27, 2010

(54) WELL PERFORATING AND FRACTURING

(75) Inventors: Gary A. Wilcox, Concord, MI (US); Porter Underwood, Bakersfield, CA (US); Scott Harvey, Bakersfield, CA (US)

(73) Assignee: Halliburton Energy Services, Inc., Duncan, OK (US)

( * ) Notice: Subject to any disclaimer, the term of this patent is extended or adjusted under 35 U.S.C. 154(b) by 1357 days.

(21) Appl. No.: 11/004,425

(22) Filed: Dec. 3, 2004

(65) Prior Publication Data

US 2008/0128132 A1 Jun. 5, 2008

(51) Int. Cl.

| | |
|---|---|
| ***E21B 43/11*** | (2006.01) |
| ***E21B 43/26*** | (2006.01) |
| ***E21B 33/12*** | (2006.01) |
| ***E21B 33/128*** | (2006.01) |

(52) U.S. Cl. ..... 166/297; 166/123; 166/182; 166/305.1; 166/308.1

(58) Field of Classification Search ..... 166/308.1, 166/297, 305.1, 123–125, 181, 182
See application file for complete search history.

(56) References Cited

U.S. PATENT DOCUMENTS

| | | | | |
|---|---|---|---|---|
| 2,204,378 | A * | 6/1940 | O'Donnell | 166/143 |
| 3,083,770 | A * | 4/1963 | Villalon, Jr. et. al. | 166/124 |
| 3,382,927 | A * | 5/1968 | Davis, Jr. | 166/124 |
| 3,584,684 | A * | 6/1971 | Anderson et al. | 166/129 |
| 4,427,063 | A * | 1/1984 | Skinner | 166/134 |
| 5,044,442 | A * | 9/1991 | Nobileau | 166/382 |
| 5,197,547 | A * | 3/1993 | Morgan | 166/387 |
| 6,394,184 | B2 * | 5/2002 | Tolman et al. | 166/281 |
| 6,543,538 | B2 | 4/2003 | Tolman et al. | |
| 6,666,275 | B2 * | 12/2003 | Neal et al. | 166/386 |

OTHER PUBLICATIONS

Halliburton, Hydra-Jet Data Manual, Section 2, p. 6 of 24, Jul. 2001.
Halliburton, BV Retrievable Bridge Plug, Retrievable Service Tools (2 pages).

* cited by examiner

*Primary Examiner*—Giovanna C Wright
(74) *Attorney, Agent, or Firm*—John W. Wustenberg; Fish & Richardson, P.C.

(57) ABSTRACT

A system and method for perforating and fracturing enables sealing device on a working string to be actuated to substantially block passage of fluids through the wellbore. Without removing the working string from the wellbore, the working string is released from the sealing device, the wellbore is perforated, and the wellbore pressurized up-hole of the sealing device to fracture the wellbore.

31 Claims, 5 Drawing Sheets

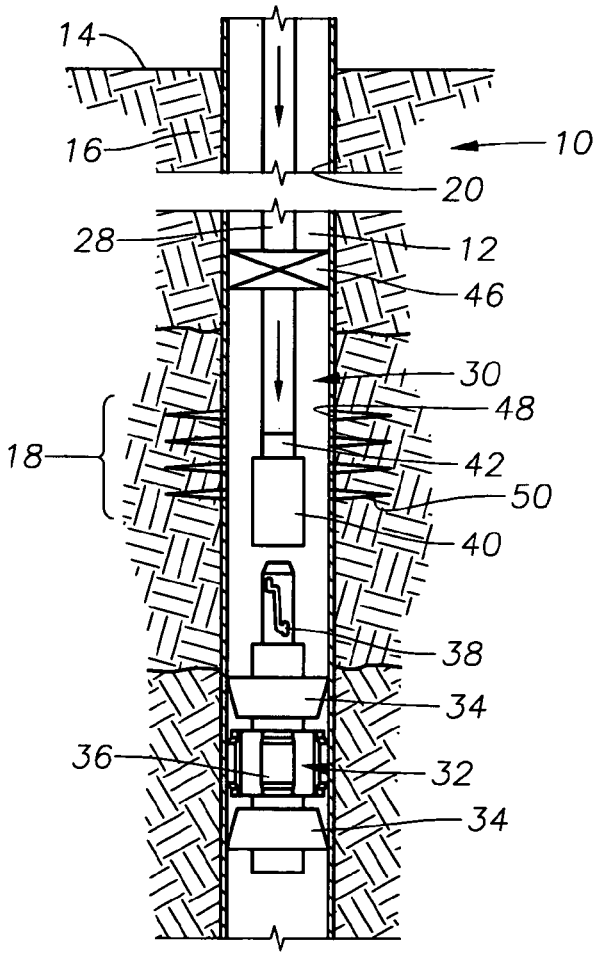
Fig. 3C
Fig. 4A
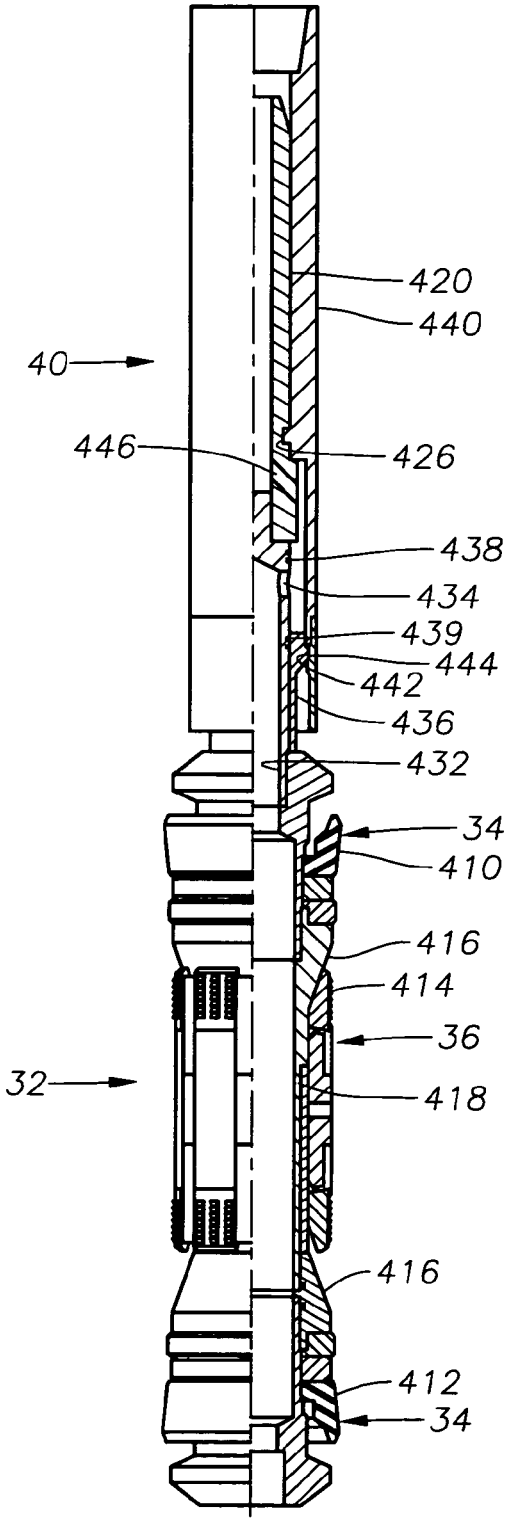

WELL PERFORATING AND FRACTURING

This disclosure relates to completing wells, and more particularly to systems and methods for perforating and fracturing wellbores.

After a wellbore is drilled, the wellbore is perforated and fractured to increase the flow of fluids from the formation into the wellbore. Perforating entails forming holes in the walls of the wellbore, for example the casing, to enable the formation around the wellbore to be fractured. Fracturing entails inducing fractures in the formation surrounding the wellbore.

Perforating is generally performed with a perforating tool that is lowered into the wellbore on a wireline or a coiled or joined tubing string. There are a number methods by which to perforate a wellbore. One method includes utilizing a jetting-type perforating tool through which a fluid passes at a pressure high enough to cut openings, or perforate the wall of a wellbore. Another method includes utilizing a shaped charge-type perforating tool that uses a directional explosive effect to generate a high pressure, high velocity jet that creates an opening or a perforation in the wall of a wellbore. Yet another method includes utilizing a projectile-type perforating tool that fires a bullet or projectile into the wall of the wellbore to create an opening or a perforation therein.

Fracturing is generally performed by sealing an interval within the wellbore, for example between two packers on a working string or between a bridge plug and a seal, such as a packer or a BOP, at the surface, and pressurizing the wellbore within the sealed interval to induce fractures in the formation surrounding the formation. The perforations allow the pressurized fracturing fluid to enter the formation.

Conventional perforating and fracturing operations require multiple trips into and out of the wellbore. In one trip, a perforating tool is positioned in the wellbore, the wellbore is perforated, and the perforating tool is withdrawn. On a subsequent trip, the working string including the packers is positioned in the wellbore, the wellbore fractured, and the working string withdrawn. Thereafter, if it is desired to perforate and fracture a wellbore in additional locations, further trips into and out of the wellbore may be required. Tripping into and out of the wellbore is labor intensive and time consuming, and it adds both time and expense to well completion operations.

SUMMARY

The present disclosure is directed to systems and methods for perforating and fracturing a wellbore.

One illustrative implementation encompasses a method for perforating and fracturing whereby a sealing device in a working string is actuated to substantially block passage of fluids through the wellbore beyond the sealing device. Without removing the working string from the wellbore, the working string is disconnected from the sealing device, the wellbore is perforated, and the wellbore is fractured.

An advantage of some implementations is that the wellbore can be perforated and fractured in a reduced number of trips, and in some instances, one trip into and out of the wellbore.

Another advantage of some implementations is that multiple intervals can be perforated and fractured in a reduced number of trips, and in some instances, one trip into and out of the wellbore.

Another advantage of some implementations is that the diameter of the working string can be substantially uniform, for example to pass through a stripping head, because the perforating tool can be introduced through an interior of the working string, rather than being a different diameter component in the working string.

Another advantage of some implementations is that the perforating pattern of the perforating tool can be changed or the perforating tool repaired without withdrawing the working string from the wellbore.

Another advantage of some implementations is that the bridge plug can be provided with a profile that allows the working string to engage the bridge plug without releasing the bridge plug to allow flow through the wellbore and/or without releasing the bridge plug's grip on the wellbore. Accordingly, the working string can be anchored to the bridge plug during fracturing to prevent the pressure from fracturing from driving the working string out of the wellbore.

BRIEF DESCRIPTION OF THE DRAWINGS

FIG. 3C is a schematic cross-sectional view depicting an alternate working string including a packer and a bridge plug while the wellbore is being fractured in accordance with an implementation of the invention;

FIG. 4A is a partial cross-sectional view of an illustrative running tool engaging an illustrative bridge plug in accordance with an implementation of the invention;

DETAILED DESCRIPTION

Figure 2:
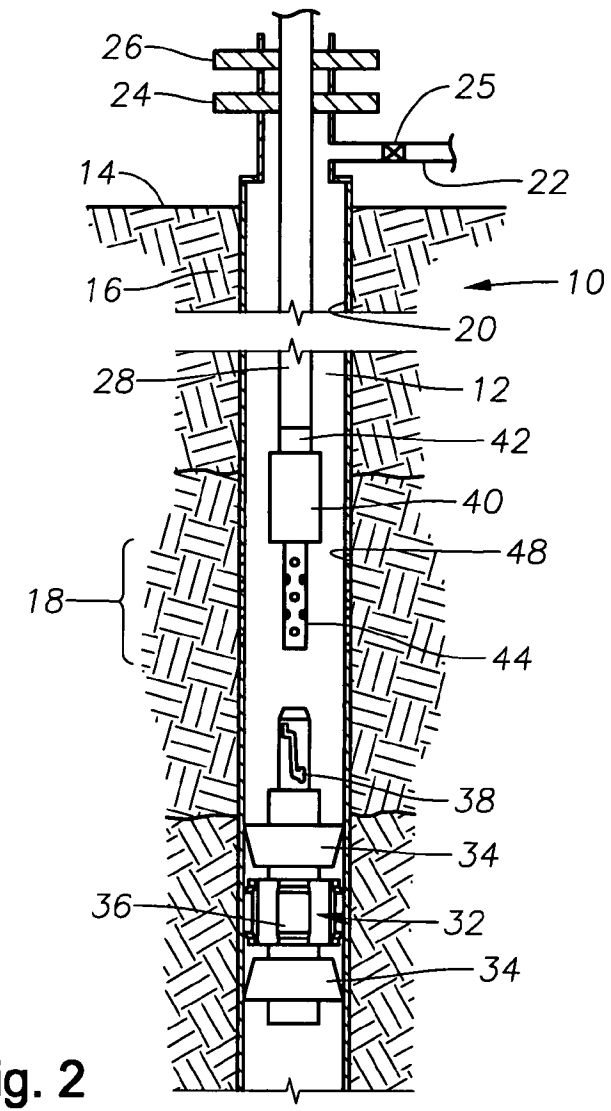
FIG. 2 is a schematic cross-sectional view depicting the working string and bridge plug of FIG. 1 perforating a wall of the wellbore in accordance with an implementation of the invention.

Referring first to FIGS. 1-3B collectively, an illustrative perforating and fracturing system 10 according to an implementation of the invention is depicted in operation in a wellbore 12. The wellbore 12 extends from a terranean surface 14 through a subterranean formation 16. Perforating and fracturing can be performed in one or more intervals 18 of the formation 16.

Figure 1:
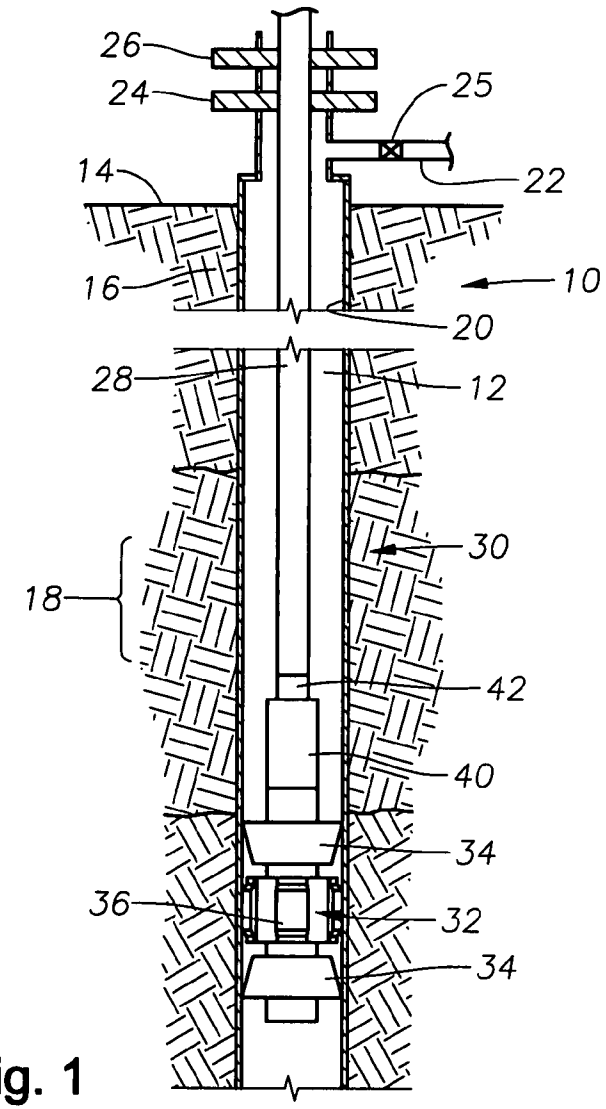
FIG. 1 is a schematic cross-sectional view depicting a working string and bridge plug in accordance with an implementation of the invention lowered into a wellbore.
Figure 3B:
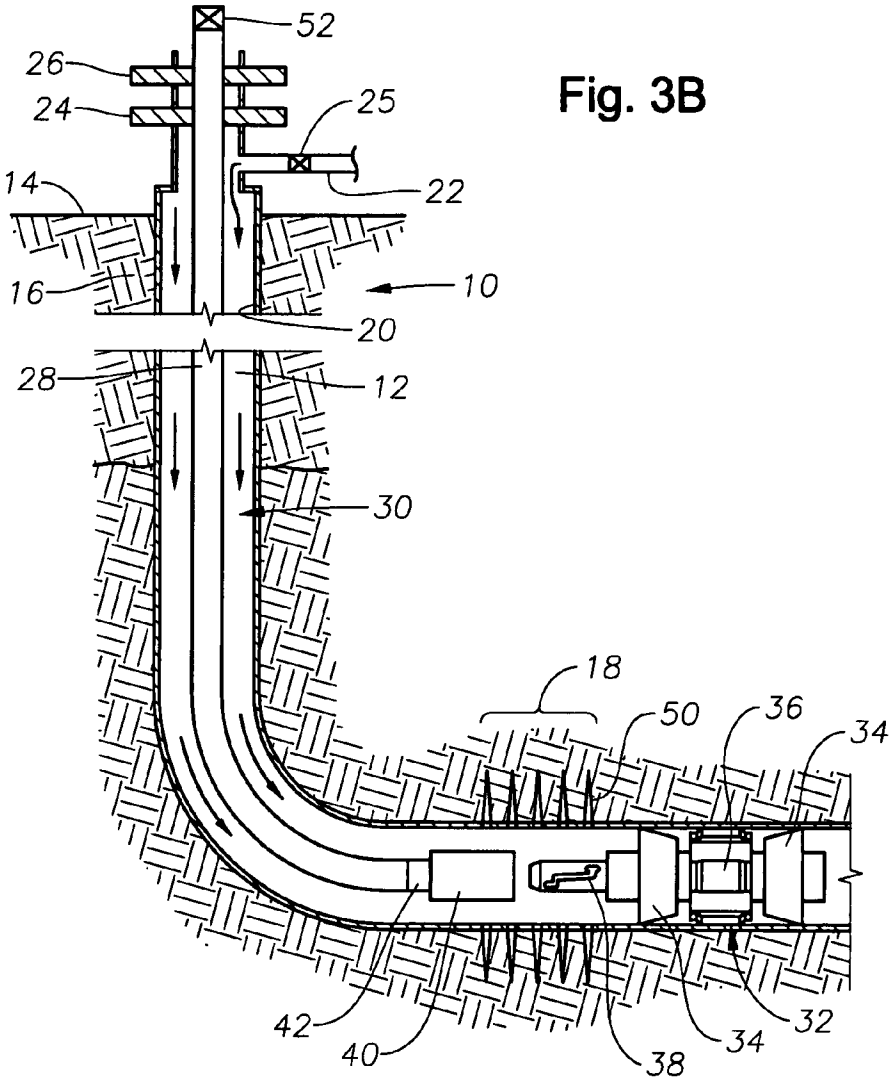
FIG. 3B is a schematic cross-sectional view depicting the working string and bridge plug of FIG. 1 in a deviated wellbore, while the wellbore is being fractured in accordance with an implementation of the invention.
Figure 3A:
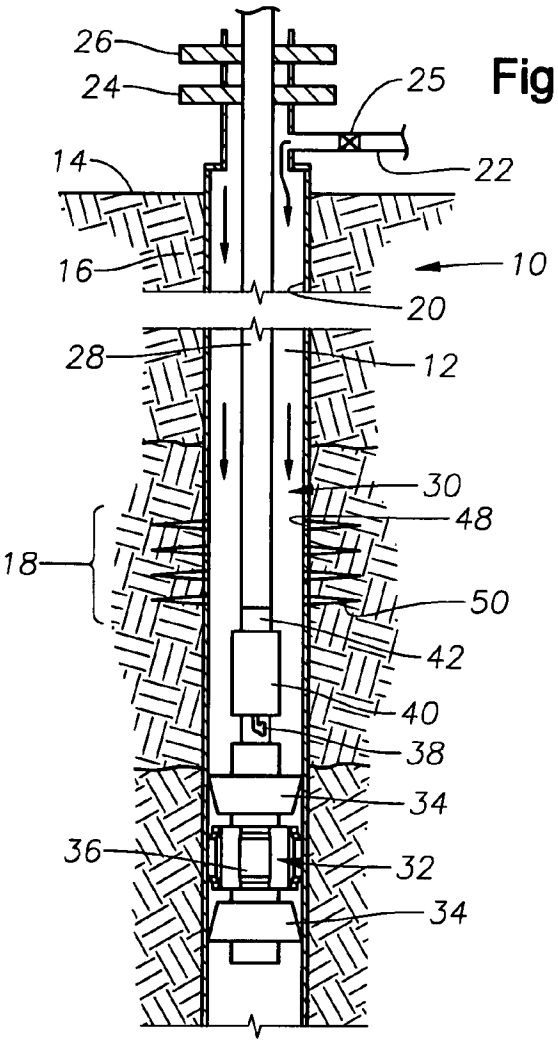
FIG. 3A is a schematic cross-sectional view depicting the working string and bridge plug of FIG. 1 while the wellbore is being fractured in accordance with an implementation of the invention.

The wellbore 12 can be a vertical wellbore as is depicted in FIG. 1, or can deviate from vertical, for example, to extend horizontal as is depicted in FIG. 3B, as well as follow numerous other paths that are neither wholly vertical or vertical curving to horizontal. The wellbore 12 can include a casing 20 that extends at least partway through the wellbore 12 and defines an interior wall thereof. Alternately, the wellbore 12 can be uncased. In an uncased wellbore or portion of the wellbore 12 without a casing 20, an interior wall of the wellbore 12 is the formation 16.

In the illustrative implementation of FIG. 1, a pumping tee 22, blow out preventer (BOP) 24 and stripping head 26 are provided at the surface 14, for example, coupled to the casing 20. The BOP 24 is adapted to close and substantially seal an annulus between a body (for example tubing 28 of working string 30, discussed below) and the wall of the wellbore 12 to maintain pressure within the wellbore 12. The stripping head 26 is likewise adapted to close and substantially seal an annulus between a body (for example tubing 28) and the wall of the wellbore 12 to maintain pressure within the wellbore 12. The stripping head 26 is further adapted to allow a body to move axially into and out of the wellbore 12 while substantially sealing the annulus. The pumping tee 22 has a lateral inlet in communication with the wellbore 12 to enable flow introduced through the inlet into the wellbore 12. A valve 25 can be provided in the inlet to selectively control flow into and out of the wellbore 12. As is discussed in more detail below, the pumping tee 22 allows the wellbore 12 to be pressurized from the surface for fracturing the wellbore 12 when the BOP 24 and/or stripping head 26 are sealed around a body. Alternately, the wellbore 12 can be pressurized for fracturing through an interior of a tubing (for example in working string 30) and the pumping tee 22 can be omitted.

The illustrative perforating and fracturing system 10 includes a working string 30 and a bridge plug 32. The bridge plug 32 can include one or more seals 34 actuable to substantially seal with a wall of the wellbore 12 and substantially block passage of fluids through the wellbore 12 beyond the bridge plug 32. The bridge plug 32 can also include wall gripping members 36, for example slips, adapted to grip the wall of the wellbore 12 and substantially anchor the bridge plug 32 in the wellbore 12. Finally, the bridge plug 32 can include a running tool engaging profile 38 at the top of the bridge plug 32 (FIG. 2) to enable a running tool 40, for example provided in the working string 30, to engage the bridge plug 32. The bridge plug running tool 40 engages the engaging profile 38 to move and otherwise position the bridge plug 32 within the wellbore 12. Further, the bridge plug running tool 40 engages the engaging profile 38 in operating to actuate the bridge plug 32 in and out of sealing with and gripping the wall of the wellbore 12.

Figure 4B:
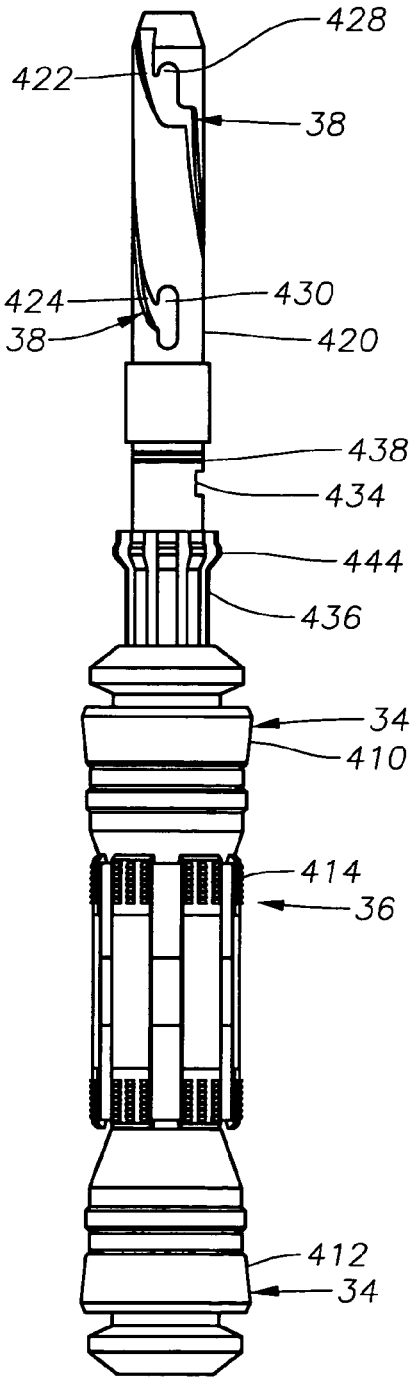
FIG. 4B is a side elevational view of the illustrative bridge plug of FIG. 4A.

Although there are numerous configurations of bridge plug 32 and bridge plug running tool 40 that can be used according to the concepts described herein, one illustrative bridge plug 32 and bridge plug running tool 40 is depicted in FIGS. 4A and 4B. The illustrative bridge plug 32 of FIGS. 4A and 4B includes a tubular central body 418 that supports the seals 34 and wall gripping members 36. The seals 34 in this instance include an upper seal 410 biased to substantially seal flow from above the bridge plug 32 down the wellbore 12 and a lower seal 412 biased to substantially seal flow from below the bridge plug 32 up the wellbore 12. The seals 410, 412 are further pressure energized, such that pressure expands the seals 410, 412 to seal tighter against the wall of the wellbore 12. The wall gripping members 36 include slips 414 residing over slip wedges 416. The outer diameter of each slip wedge 416 is conical, sloping radially inward towards the center of the bridge plug 32, and the inner diameter of the slips 414 corresponds in profile to the outer diameter slip wedges 416. The slip wedges 416 are coupled to the central body 418 such that clockwise rotation of the central body 418 axially translates the slip wedges 416 toward one another and wedges the slips 414 radially outward, for example outward into the wall of the wellbore. The slips 414 are self energized in that if gripping the wall of the wellbore, any further axial movement of the bridge plug 32, such as that caused by pressure exerted at seals 410, 412, wedges the slips 414 further radially outward and into tighter engagement with the wall of the wellbore. Counterclockwise rotation of the central body 418 axially translates the slip wedges 416 away from one another allowing the slips 414 to move radially and inward out of engagement with the wall of the wellbore.

As best seen in FIG. 4B, the central body 418 includes a running tool engaging stub 420 extending axially above the remainder of the bridge plug 32. The stub 420 is adapted to be received within a cylindrical housing 440 of the running tool 40 (FIG. 4A). The stub 420 is provided with two tool engaging profiles 38 on opposing sides of the stub 420. Each engaging profile 38 is provided in the form of a pair of interconnected J-slots, an upper J-slot 422 and a lower J-slot 424. The J-slots 422, 424 are adapted to receive a pin 426 affixed to and inwardly extending from the interior of the housing 440. Although only one pin 426 is visible in the partial cross-sectional view of FIG. 4A, a pin 426 can be provided for each engaging profile 38. In each engaging profile 38, the upper J-slot 422 is open to the top of the tool engaging stub 420 to accept the pin 426 as the running tool 40 is lowered over the stub 420. Once in the upper J-slot 422, the pin 426 can travel between the two J-slots 422, 424.

Both the upper and lower J-slots 422 and 424 are oriented in the same direction, so that counterclockwise rotation of the running tool 40 moves the pin 426 into a receptacle portion 428, 430 of the J-slots 422, 424. Once the pin 426 is received in a receptacle portion 428, 430, an upward pull on the running tool 40 sets the pin 426 fully into the respective receptacle portion 428, 430. The pin 426 being set in the receptacle portion 428, 430 enables rotation of the running tool 40 clockwise to rotate the stub 420, and thus the central body 418, clockwise, as well as, enables the running tool 40 to lift the bridge plug 32. As noted above, clockwise rotation of the central body 418 operates to extend the wall gripping members 36 (slips 414). The receptacle portion 430 of the lower J-slot 424 can extend downward so that downward movement of the running tool 40 together with counterclockwise rotation also engages the pin 426. Further, the receptacle portion 430 of the lower J-slot 424 can be configured to enable the running tool 40 to rotate the stub 420, and thus central body 418, clockwise. As noted above, counterclockwise rotation of the central body 418 operates to retract the wall gripping members 36 (slips 414).

The central body 418 defines an interior passageway 432 through the interior of the bridge plug 32. The interior passageway 432 is open at the bottom of the bridge plug 32 and communicates with a lateral window 434 in the central body 418 beneath the stub 420. The central body 418 receives a cover sleeve 436 to slide axially from below the window 434 to cover the window 434. Seals 438, 439 are positioned above and below the window 434 and adapted to substantially seal with the cover sleeve 436, so that when the cover sleeve 436 covers the window 434, the window 434 is substantially sealed shut and flow cannot pass through the window 434. The central body 418 is conical above the window 434 to frictionally hold the cover sleeve 436 in the closed position.

The running tool housing 440 is configured to translate the cover sleeve 436 downward to open the window 434 and engage the cover sleeve 436 when the running tool 40 receives the stub 420 deeply enough for the pin 426 to be received in the receptacle portion 430 of the lower J-slot 424. Once engaging the cover sleeve 436, the running tool housing 440 draws the cover sleeve 436 upward to close the window 434 as the running tool 40 is pulled off of the bridge plug 32. To this end, the running tool housing 440 has a circumferential ridge 442 on its internal diameter that has a slightly smaller diameter than a corresponding ridge 444 on the exterior of the cover sleeve 436. As the running tool 40 is received over the stub 420, the circumferential ridge 442 impacts the corresponding ridge 444 and pushes the cover sleeve 436 downward to open the window 434. When the running tool 40 receives the stub 420 to a depth at which the pin 426 could engage the receptacle portion 430 of the lower J-slot 424, the circumferential ridge 442 is forced past the corresponding ridge 444 thus capturing the cover sleeve 436. Thereafter, pulling the running tool 40 upward draws the cover sleeve 436 up until it seals against the seal 438 above the window 434. As the running tool 40 is pulled off of the stub 420, the circumferential ridge 442 is forced past corresponding ridge 444 and the cover sleeve 436 is released from the running tool housing 440. The running tool housing 440, stub 420 and cover sleeve 436 are configured so that the running tool housing 440 neither engages the cover sleeve 436 nor opens the window 434 when the pin 426 is in position to be received in the receptacle portion 428 of the upper J-slot 422.

Because of the self energized slips 414 and slip wedges 416 and the pressure energized seals 410, 412, pressure on either side of the bridge plug 32 fortifies the seal and grip the bridge plug 32 has on the wellbore. Therefore, in releasing the bridge plug 32 from the wellbore, the pressure across the bridge plug 32 is equalized by opening the window 434. When the running tool 40 is received over the stub 420 and engaging the lower J-slot 424, the window 434 is opened and a flow path 446 is defined from the window 434 up to the interior of the running tool 40 and into the interior of the tubing 28 (FIG. 1). Thereafter, counterclockwise rotation of the running tool 40 releases the wall gripping members 36 enabling the bridge plug 32 to be repositioned in or removed from the wellbore. Of note, engaging the bridge plug 32 without equalizing pressure across the bridge plug 32, for example by engaging the bridge plug 32 at the upper J-slot 422 without opening window 434, hinders or may prevent the seal and grip with the interior of the wellbore 12 from being released. This is because the pressure acting to energize the seals 410, 412 and slips 414 must be overcome to release the seals 410, 412, and slips 414.

Referring again to FIGS. 1-3B, the working string 30 includes one or more interconnected joints of tubing 28, for example rigid pipe, the bridge plug running tool 40 and a seating nipple 42. As seen in FIG. 3C the working string 30 can also include a packer 46 spaced from the running tool 40. The seating nipple 42 is affixed to the end of the tubing 28 and is adapted to receive and locate a perforating tool 44 in relation to the working string 30 (FIG. 2). The perforating tool 44 is adapted to be introduced from the surface 14 and travel along the working string 30 to the seating nipple 42. In one implementation, the perforating tool 44 can be configured to travel through an interior of the working string 30, for example, by being pumped through the interior of the working string 30. Once seated at the seating nipple 42, the perforating tool 44 can be operated to perforate the wall of the wellbore 12 (cased or uncased) or other body in the wellbore 12. There are numerous methods by which the perforating tool 44 can operate to perforate the wall of the wellbore 12. Some examples include perforating by shaped charge, projectile, or hydraulic pressure.

Figure 5:
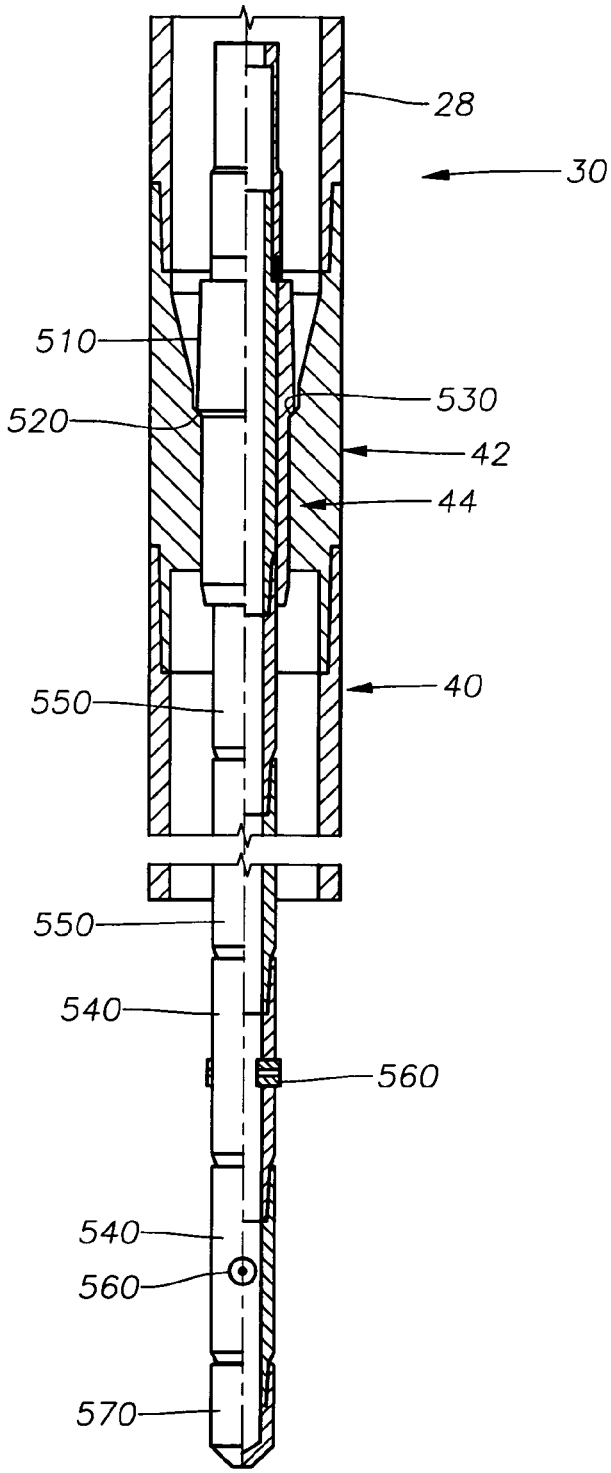
FIG. 5 is a partial cross-sectional view of an illustrative perforating tool, seating nipple and running tool in accordance with an implementation of the invention.

Although there are numerous other configurations of seating nipple 42 and perforating tool 44 that can be used according to the methods described herein, one illustrative seating nipple 42 and perforating tool 44 is depicted in FIG. 5. The illustrative perforating tool 44 of FIG. 5 is a hydraulic perforating tool adapted to direct pressurized fluid from its interior to perforate the wall of the wellbore 12. Furthermore, the illustrative perforating tool 44 of FIG. 5 is adapted to travel from the surface to the seating nipple 42 through an interior of the working string 30. To this end, the illustrative perforating tool 44 has an elongate tubular main body 510 that is sized to pass through the interior of the working string 30. The main body 510 defines a seating profile 520 on its outer surface that is adapted to be received in a corresponding seating profile 530 defined on an interior surface of the seating nipple 42. The seating profile 520 and corresponding seating profile 530 substantially seal with one another as hydraulic pressure is introduced in the interior of the working string 30.

The main body 510 is adapted to receive pressurized fluid from the working string 30 through one end and is adapted to join to a jet body 540 or blank body 550 at the other end. The blank body 550 is tubular and adapted to join to the main body 510, a jet body 540, or another blank body 550 at one end and another blank body 550 or jet body 540 at the other end. The jet body 540 is also tubular and adapted to join to the main body 510, a blank body 550, or another jet body 540 at one end and another jet body 540 or blank body 550 at the other end. However, the jet body 540 further includes one or more radial ports 560 adapted to direct pressurized fluid from within the jet body 540 radially outward. A single jet body 540 or various combinations of jet bodies 540 and blank bodies 550 can be joined together and to the main body 510 to define a perforating pattern. In the illustrative perforating tool 44 of FIG. 5, one or more blank bodies 550 are joined to the main body 510 and a plurality of jet bodies 540 joined to the blank bodies 550 to position the jet bodies 540 below the running tool 40 when the perforating tool 44 is received in the seating nipple 42. A cap 570 can be joined to the open end of the last jet body 540 to substantially seal the end of the perforating tool 44.

The illustrative perforating tool 44 of FIG. 5 can be pumped down the interior of the working string 30 to seat and substantially seal in the seating nipple 42. After operation, the perforating tool 44 can be pumped back up the working string 30 and out of the wellbore or can be retrieved using a fishing tool (not shown). The perforating pattern of the perforating tool 44 can be adjusted or the perforating tool 44 repaired, for example, by retrieving the perforating tool 44, re-configuring or replacing the combination of jet bodies 540 and or blank bodies 550, and re-introducing the perforating tool 44 down the working string 30.

Figure 6:
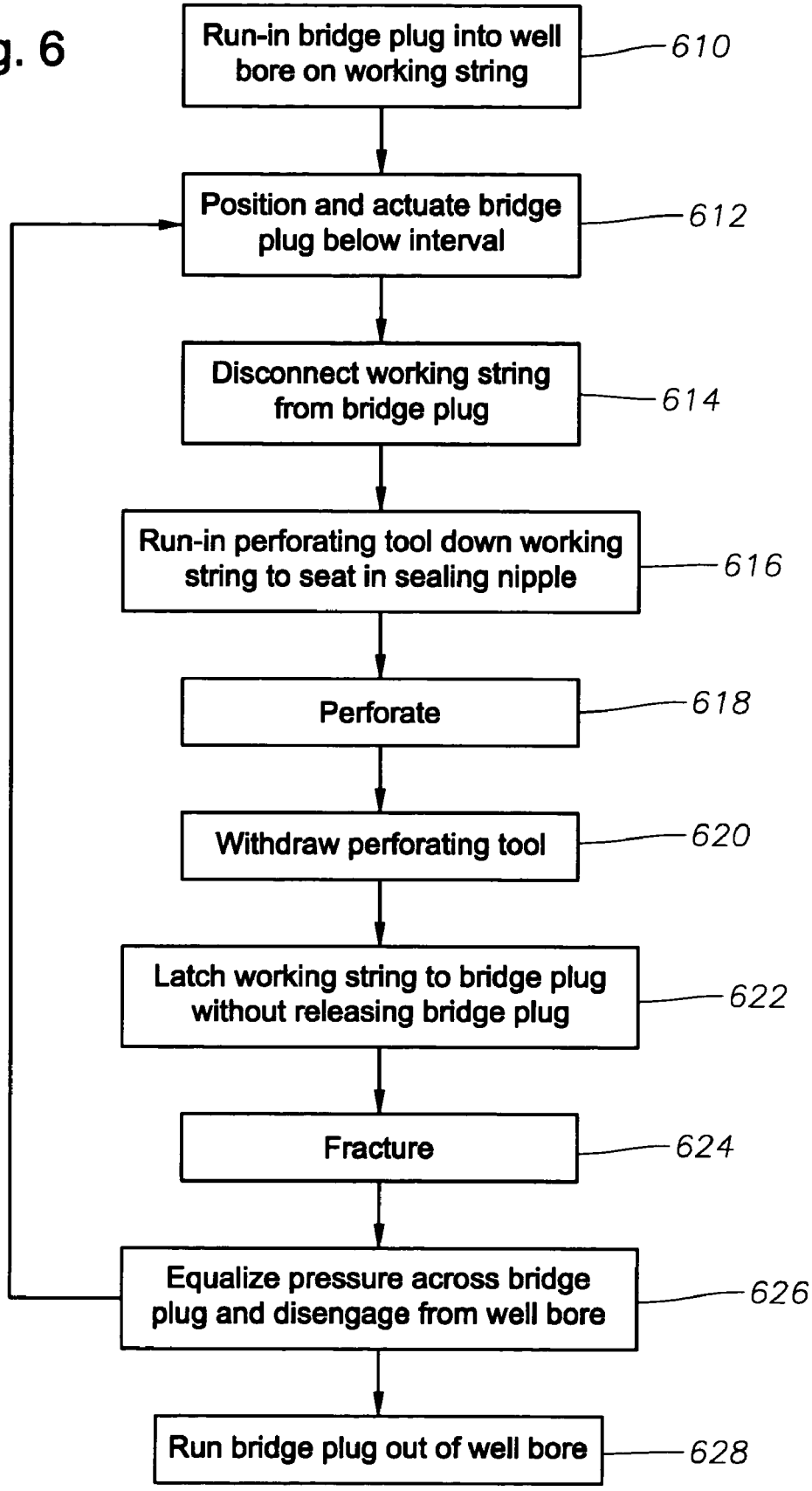
FIG. 6 is a flow diagram of a method of perforating and fracturing a wellbore in accordance with an implementation of the invention.

FIG. 6 depicts a flow diagram of an illustrative method of perforating and fracturing a wellbore according to the sequence of operations depicted in FIGS. 1-3C. According to the method, at block 610 the perforating and fracturing working string 30 is run into the wellbore 12 carrying the bridge plug 32. The running tool 40 can be operated to engage the running tool engaging profile 38, and actuate the bridge plug 32 to allow passage of fluids therethrough. For example, in an instance of a bridge plug 32 as in FIG. 4A, the running tool 40 can engage the bridge plug 32 at the lower J-slot 424, thus opening window 434. With window 434 open, pressure is communicated across the bridge plug 32 through the interior passageway 432.

At block 612, the bridge plug 32 is positioned below the perforating and fracturing interval 18 and actuated to substantially block passage of fluids through the wellbore 12. For example, in an instance of a bridge plug 32 as in FIG. 4A, the working string 30 can be rotated clockwise to extend the wall gripping members 36 (slips 414) to grip the wall of the wellbore 12. Thereafter, releasing the running tool 40 from the lower J-slot 424 and drawing the running tool 40 upward, draws the cover sleeve 436 up over window 434. With the cover sleeve 436 over the window 434, the bridge plug 32 substantially blocks flow through the bridge plug 32 and through the wellbore 12 beyond the bridge plug 32.

At block 614, the working string 30 is disconnected from the bridge plug 32. In the bridge plug 32 of FIGS. 4A and 4B, the running tool 40 is disconnected from the bridge plug 32 by releasing tension in the working string 30, rotating the working string 30 clockwise out of the receptacle portion 430 of the lower J-slot 424, and drawing the working string 30 upward. Thereafter, the end of the working string 30 can be positioned proximate the location of desired perforations. It should be noted that disconnecting the working string 30 from the bridge plug 32 allows the position of the working string 30 (and thus perforating tool 44) to be changed in relation to the bridge plug 32 for perforating operations.

At block 616, the perforating tool 44 is run-in the wellbore 12 down the working string 30. For example, in an instance of a perforating tool 44 as in FIG. 5, the perforating tool 44 can be pumped down an interior of the working string 30 to seat and substantially seal in the seating nipple 42.

At block 618, the perforating tool 44 is operated to perforate the wall (such as the casing 20) of the wellbore 12. The perforating tool 44 may be operated multiple times, for example, to perforate multiple locations within the wellbore 12. In such an instance, the perforating tool 44 is operated in a first location, the working string 30 repositioned axially within the wellbore 12, the perforating tool 44 operated in a second location, and so on. The perforating tool 44 can operate by shaped charge, projectile, hydraulic pressure or numerous other methods for perforating the wall of a wellbore. With the perforating tool 44 of FIG. 5, perforating can be performed by introducing high pressure fluid, and in some instances a particulate cutting agent, into the interior of the working string 30. The high pressure fluid and the cutting agent (if provide) are jetted out of the perforating tool 44 and into the wall of the wellbore 12 to cut openings or perforations 48 (FIG. 2). In one instance the cutting agent may include sand.

At block 620 the perforating tool 44 is withdrawn from the wellbore 12. With the perforating tool 44 of FIG. 5, the perforating tool 44 can be pumped up the interior of the working string 30 or retrieved mechanically, for example with a fishing tool (not shown).

At block 622, the working string 30 may be lowered and latched to the bridge plug 32 without releasing the bridge plug 32 to allow flow through the wellbore 12 beyond the bridge plug 32. With the bridge plug 32 of FIGS. 4A and 4B, the running tool 40 can engage the receptacle portion 428 of the upper J-slot 422 without opening the window 434 and allowing communication of pressure across the bridge plug 32. If a pressure differential is maintained across the bridge plug 32 (i.e. with window 434 remaining closed), the pressure energized nature of the seals 410, 412 and slips 414 and slip wedges 416 combination will hinder unintentional release of the bridge plug 32.

At block 624, the wellbore 12 is fractured by pressurizing the wellbore 12 until cracks or fractures 50 form in the formation 16 surrounding the wellbore 12. The wellbore 12 may be pressurized through the pumping tee 22 or through the interior of the working string 30 (in which case the pumping tee 22 can be omitted) with the stripping head 26 and/or BOP 24 closed to seal the annulus around the working string 30. Alternately, as seen in FIG. 3C, a packer 46 can be provided in the working string 30 to seal the annulus around the working string 30. The packer 46 and bridge plug 32 define a smaller sealed interval that may be desirable when pressurizing the entire wellbore 12 is not desirable, for example, when other portions of the wellbore 12 cannot be pressurized for fracturing.

Block 622 may be omitted, for example, if the weight of the working string or the pressure during fracturing is such that pressurizing the formation during fracturing will not drive the working string 30 out of the wellbore 12. Further, it may be desirable to include a valve 52 in the working string 30 (FIG. 3B) either at the surface or in the wellbore 12 that may be closed to prevent flow of pressurized fracturing fluids from flowing up the interior of the working string 30.

At block 626, the running tool 40 is landed on the bridge plug 32 and operated to release the bridge plug 32 from the wellbore 12. In an instance of the bridge plug 32 of FIGS. 4A and 4B, engaging the bridge plug 32 with the running tool 40 at the lower J-slot 424 opens the window 434. With window 434 open, pressure across the bridge plug 32 is equalized, as pressure may communicate through the interior passageway 432. Thereafter, counterclockwise rotation of the working string 30 rotates the central body 418 and allows the slips 414 to retract and the bridge plug 32 to release from the wall of the wellbore 12.

After performing block 626, if it is desired to perforate and fracture another location within the wellbore 12, operations can return to block 612. To with, the bridge plug 32 would be positioned and actuated below another perforating and fracturing interval (block 612), and the remaining blocks 614-626 repeated. Blocks 612-626 may be repeated as desired to perforate and fracture additional intervals.

When the desired perforating and fracturing operations are complete, operations can progress to block 628 and the bridge plug 32 be withdrawn from the wellbore 12.

Of note, the operations of the above-described method need not be performed in the order depicted in FIG. 6. For example, depending on the configuration of the working string 30, the bridge plug 32 may be positioned or actuated after the wellbore 12 has been perforated (block 618). In another example, depending on the configuration of the working string 30, the perforating tool 44 may be withdrawn from the wellbore 12 after the wellbore 12 has been fractured (block 624). Numerous other variations to the order of the method are within the concepts described herein.

Although several illustrative implementations of the invention have been described in detail above, those skilled in the art will readily appreciate that many other variations and modifications are possible without materially departing from the concepts described herein. Accordingly, other implementations are intended to fall within the scope of the invention as defined in the following claims.

What is claimed is:

1. A method for perforating and fracturing, comprising:

actuating a sealing device in a working string to substantially block passage of fluids through a well bore beyond the sealing device;

without removing the working string from the well bore, disconnecting the working string from the sealing device;

perforating the well bore; and fracturing the well bore.

2. The method of claim 1, further comprising without removing the working string from the well bore, repositioning the sealing device to another location within the well bore.

3. The method of claim 2, further comprising:

actuating the sealing device to substantially block passage of fluids through the well bore beyond the sealing device;

without removing the working string from the well bore, disconnecting the working string from the sealing device;

perforating the well bore; and pressurizing the well bore before the sealing device to fracture the well bore.

4. The method of claim 1 further comprising after perforating, repositioning a perforating device at a second location and perforating the well bore.

5. The method of claim 1 further comprising:

pressurizing the well bore before the sealing device; and prior to pressurizing the well bore before the sealing device, engaging the sealing device with the working string.

6. The method of claim 5 wherein the sealing device has an actuating engaging profile and an anchoring engaging profile, the actuating engaging profile is adapted to enable the working string to actuate the sealing device to allow passage of fluids through the well bore beyond the sealing device, and the anchoring engaging profile is adapted to be engaged by the working string, but hinders the working string from actuating the sealing device to allow passage of fluids; and wherein engaging the sealing device with the working string prior to pressurizing the well bore comprises engaging the anchoring engaging profile with the working string.

7. The method of claim 1 further comprising:

pressurizing the well bore before the sealing device; and prior to pressurizing the well bore before the sealing device, substantially blocking flow through an interior of the working string.

8. The method of claim 7 wherein substantially blocking flow through an interior of the working string comprises actuating a valve at least one of within the well bore or outside of the well bore.

9. The method of claim 1 further comprising actuating the sealing device to grip a wall of the well bore.

10. The method of claim 1 wherein the working string includes a first sealing device and a second sealing device in the well bore;

wherein actuating the sealing device to substantially block passage of fluids through the well bore beyond the sealing device comprises actuating the first and second sealing devices to define a sealed interval therebetween; and wherein the method further comprises pressurizing the well bore between the first and second sealing devices to fracture the well bore.

11. A method of perforating and fracturing, comprising:

providing a working string including a sealing device and a perforating device in a well bore;

without removing the working string from the well bore, perforating the well bore in a first location using the perforating device;

repositioning the perforating device to a second location and perforating the well bore using the perforating device;

removing the perforating device from the working string after perforating the well bore;

sealing an interior of the well bore to substantially prevent passage of fluids through the well bore using the sealing device; and fracturing the well bore.

12. The method of claim 11 further comprising without removing the working string from the well bore, moving the sealing device to another location.

13. The method of claim 12 further comprising perforating the well bore in a third location and fracturing the well bore again.

14. The method of claim 12 further comprising while fracturing the well bore, engaging the sealing device with the working string without actuating the sealing device to release the seal that prevents passage of fluids through the well bore.

15. The method of claim 11 further comprising while fracturing the well bore, substantially blocking flow through an interior of the working string.

16. The method of claim 11 wherein the working string includes a second sealing device; and wherein sealing an interior of the well bore to substantially prevent passage of fluids through the well bore comprises sealing an interval between the first and the second sealing devices.

17. A system for insertion into a well bore, comprising:

a working string, comprising:

one or more interconnected joints of tubing; and a sealing device running tool affixed to the tubing and adapted to engage the sealing device positioned in the well bore;

a sealing device actuable between sealing with an interior of the well bore to substantially block passage of fluids through the well bore past the sealing device and allowing passage of fluids through the well bore past the sealing device, the sealing device engageable by the sealing device running tool in a first manner that enables the sealing device running tool to be used in actuating the sealing device and a second manner that hinders the sealing device running tool from actuating the sealing device; and a perforating device coupled to the working string and adapted to perforate a wall of the well bore.

18. The system of claim 17 wherein the perforating device is adapted to be coupled to the working string while the working string is residing in the well bore.

19. The system of claim 17 wherein the perforating device is adapted to be introduced through an interior of the working string while the working string is residing in the well bore.

20. The system of claim 19 wherein the perforating device is received in a seating nipple of the working string.

21. The system of claim 17 wherein the perforating device is adapted to perforate the wall of the well bore by at least one of shaped charge, projectile, or hydraulic pressure.

22. The system of claim 17 further comprising a second sealing device offset from the first sealing device.

23. The system of claim 17 further comprising a valve adapted to substantially block flow through an interior of the working string.

24. The system of claim 17 wherein when engaged by the running tool in the first manner of engaging the sealing device allows passage of fluids through the well bore; and wherein when engaged by the running tool in the second manner of engaging the sealing device substantially blocks passage of fluids through the well bore.

25. The system of claim 17 wherein the sealing device comprises a first slot receptacle adapted to receive a protrusion from the running tool and a second slot receptacle adapted to receive the protrusion from the running tool; and wherein the sealing device is adapted to allow passage of fluids through the well bore when the protrusion from the running tool is received in the first slot receptacle and to block passage of fluids through the well bore when the protrusion from the running tool is received in the second slot receptacle.

26. The system of claim 25 wherein at least one of the first or second slot receptacle comprises a J-slot.

27. A device, comprising:

a sealing device engageable in a first manner operable to enable the sealing device to be actuated from substantially sealing passage of fluids through a well bore to allowing passage of fluids through the well bore and engageable in a second manner operable to substantially prevent the sealing device from being actuated from substantially sealing passage of fluids through a well bore to allowing passage of fluids through the well bore;

a tubular central body having an inlet and an outlet;

a seal on the central body between the inlet and the outlet adapted to seal an annular area between the central body and the well bore to substantially seal passage of fluids through the well bore;

a blocking member coupled to the central body changeable between blocking flow through the central body and allowing flow through the central body; and an engaging profile on the central body adapted to enable a working string to engage the central body and actuate the blocking member to allow flow through the central body and engage the central body without actuating the blocking member to allow flow through the central body.

28. The sealing device of claim 27 wherein the engaging profile comprises a first slot receptacle adapted to receive a protrusion of the working string and a second slot receptacle adapted to receive a protrusion of the working string; and wherein the sealing device is adapted actuate the blocking member to allow passage of fluids through the central body when the protrusion from the running tool is received in the first slot receptacle and to block passage of fluids through the central body when the protrusion from the running tool is received in the second slot receptacle.

29. The sealing device of claim 28 wherein at least one of the first slot receptacle and the second slot receptacle comprises a J-slot.

30. A method of perforating and fracturing, comprising:

providing a working string including a sealing device and a perforating device in a well bore;

without removing the working string from the well bore, perforating the well bore in a first location using the perforating device;

repositioning the perforating device to a second location and perforating the well bore using the perforating device;

sealing an interior of the well bore to substantially prevent passage of fluids through the well bore using the sealing device;

fracturing the well bore;

while fracturing the well bore, engaging the sealing device with the working string without actuating the sealing device to release the seal that prevents passage of fluids through the well bore; and moving the sealing device to another location.

31. A method of perforating and fracturing, comprising:

providing a working string including a sealing device and a perforating device in a well bore;

without removing the working string from the well bore, perforating the well bore in a first location using the perforating device;

repositioning the perforating device to a second location and perforating the well bore using the perforating device;

sealing an interior of the well bore to substantially prevent passage of fluids through the well bore using the sealing device;

fracturing the well bore; and while fracturing the well bore, substantially blocking flow through an interior of the working string.

* * * * *